US008505992B2

(12) United States Patent
Arseculeratne et al.

(10) Patent No.: US 8,505,992 B2
(45) Date of Patent: Aug. 13, 2013

(54) CRIB MATTRESS CADDY

(76) Inventors: Ruwan Jude Arseculeratne, Reston, VA (US); Rex Fernando Arseculeratne, Round Rock, TX (US)

( * ) Notice: Subject to any disclaimer, the term of this patent is extended or adjusted under 35 U.S.C. 154(b) by 77 days.

(21) Appl. No.: 13/156,329

(22) Filed: Jun. 8, 2011

(65) Prior Publication Data

US 2011/0297710 A1 Dec. 8, 2011

Related U.S. Application Data

(60) Provisional application No. 61/352,802, filed on Jun. 8, 2010.

(51) Int. Cl.
*A45F 5/00* (2006.01)

(52) U.S. Cl.
USPC ..... 294/157; 294/150; 294/152

(58) Field of Classification Search
USPC ..... 294/149–157, 165
See application file for complete search history.

(56) References Cited

U.S. PATENT DOCUMENTS

| | | | | |
|---|---|---|---|---|
| 604,043 | A | 5/1898 | Hall | |
| 618,333 | A | 1/1899 | Colteryahn | |
| 679,656 | A | 7/1901 | Whiting | |
| 841,902 | A | 1/1907 | Shumard | |
| 897,979 | A | 9/1908 | Holding | |
| 1,212,190 | A * | 1/1917 | Davis | 294/155 |
| 1,709,995 | A | 4/1929 | Mulkey | |
| 1,916,793 | A | 7/1931 | Harper | |
| 2,399,786 | A * | 5/1946 | Caton | 294/153 |
| 2,508,795 | A | 5/1950 | Nielsen | |
| 2,515,826 | A * | 7/1950 | Hall | 294/153 |
| 3,968,911 | A * | 7/1976 | Haas | 224/158 |
| 4,104,750 | A | 8/1978 | Kelter et al. | |
| 4,156,498 | A * | 5/1979 | Miller | 294/151 |
| 4,431,226 | A | 2/1984 | Weilert | |
| 4,553,780 | A | 11/1985 | Strachan | |
| 4,968,049 | A * | 11/1990 | Johnson | 294/151 |
| 5,860,174 | A | 1/1999 | Failor | |
| 5,918,785 | A * | 7/1999 | Irose | 224/259 |
| 6,193,293 | B1 | 2/2001 | Ybanez | |
| 6,736,437 | B2 * | 5/2004 | Freeland | 294/152 |
| 7,311,343 | B2 | 12/2007 | Callebresi | |
| 7,390,042 | B1 | 6/2008 | Miller | |
| 2004/0145202 | A1 * | 7/2004 | Dela Paz | 294/157 |
| 2008/0211246 | A1 | 9/2008 | Schorner | |

* cited by examiner

*Primary Examiner* — Saul Rodriguez
*Assistant Examiner* — Gabriela Puig
(74) *Attorney, Agent, or Firm* — Mei & Mark LLP; Krystyna Colantoni

(57) ABSTRACT

A crib mattress caddy includes at least two top mounting straps and at least two bottom mounting straps. The caddy also includes front and back brackets each including an inner surface for interfacing with a mattress. A primary tilting strap and a primary lifting strap are also included. The inner surfaces of the front and back brackets interface with a mattress. The top and bottom mounting straps are both attached to the front and back brackets. The primary tilting strap is attached to the front bracket. The primary lifting strap is attached to the back bracket.

17 Claims, 7 Drawing Sheets

CRIB MATTRESS CADDY

This application claims the benefit of priority of provisional patent application 61/352,802 filed Jun. 8, 2010, the content of which is incorporated by reference in its entirety.

TECHNICAL FIELD

The present invention relates generally to a mattress attachment designed to facilitate the extraction and installation of a mattress from or to a crib. The device is designed to install on the exterior of a crib mattress and is mostly covered by a mattress pad or sheet to limit access to the device.

BACKGROUND

Children's cribs are designed with many safety concerns in mind. The child should not fall between the crib railings and mattress, nor should any part of the child be wedged in the railings or mattress so as to facilitate suffocation. Additionally, the child should not be able to roll or climb out of the crib.

Each of these safety concerns can result in difficulty removing the crib mattress from the crib when it is time to change the bedding. It can be difficult to reach the mattress due to the railing height and it can be difficult to grip the mattress due to the tight fit between the railings and mattress. This issue becomes more acute when the mattress is at its lowest position in the crib and when a fixed-side crib is used.

SUMMARY

The crib mattress caddy is designed to facilitate the extraction and installation of a crib mattress from or to a crib, where the mattress is surrounded on four sides by the wall or railings of the crib. The device facilitates achieving sufficient access or leverage on the mattress for the installation or extraction processes while maintaining the safety and comfort of the child using the crib.

To aid in the installation and removal of a crib mattress to and from a crib, we propose a new crib mattress caddy. The crib mattress caddy includes at least two top mounting straps and at least two bottom mounting straps. The caddy also includes front and back brackets each including an inner surface for interfacing with a mattress. A primary tilting strap and a primary lifting strap are also included.

The inner surface of the front and back bracket interface with a mattress. The top and bottom mounting straps are both attached to the front and back brackets. The primary tilting strap is attached to the front bracket. The primary lifting strap is attached to the back bracket.

In an alternative embodiment, the mattress caddy may comprise two mounting straps configured to encircle a mattress, a front bracket comprising an inner surface configured for interfacing with two perpendicular planes of the mattress, a primary tilting strap, and a primary lifting strap. The two mounting straps may be attached to the front bracket. The primary tilting strap may be attached to the front bracket, and the primary lifting strap may be attached to each of the two mounting straps.

BRIEF DESCRIPTION OF THE DRAWINGS

The accompanying drawings, which are incorporated in and constitute a part of this specification, illustrate an embodiment of the crib mattress caddy and together with the description, serve to describe the installation and operation of the crib mattress caddy.

DETAILED DESCRIPTION

Figure 1:
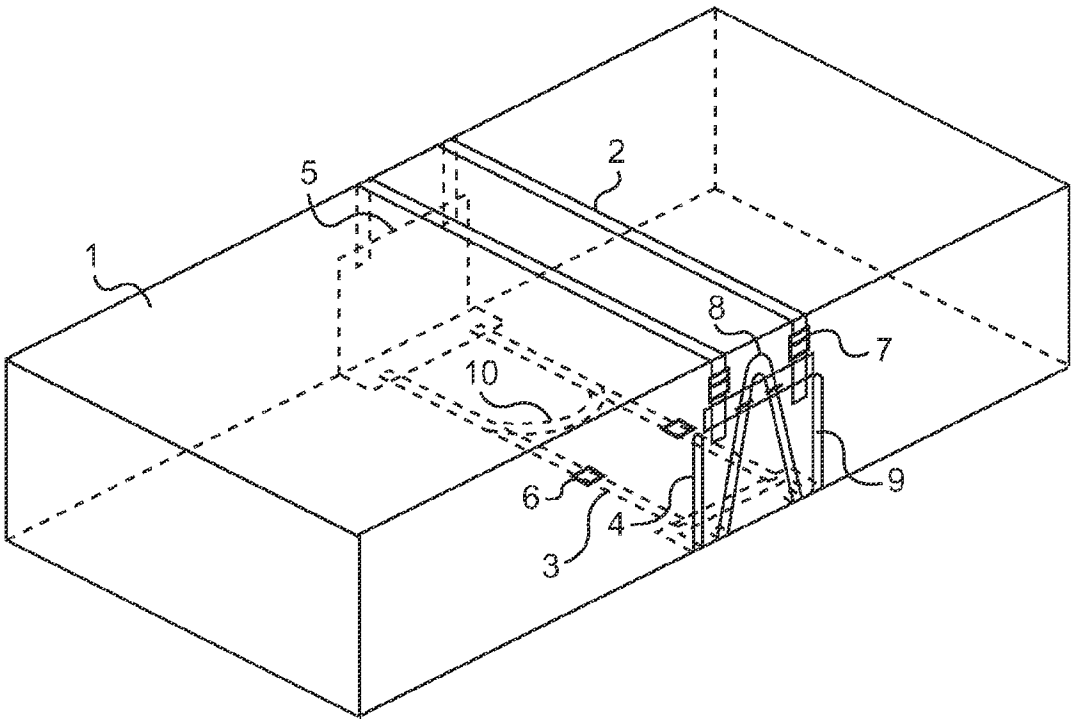
FIG. 1 is a schematic of the crib mattress caddy installed on a crib mattress.

Reference will now be made in detail to the present exemplary embodiment, an example of which is illustrated in the accompanying drawings. Wherever possible, the same reference numbers will be used throughout the drawings to refer to the same or like parts.

The components of the crib mattress caddy may include, but are not limited to, the following items (See FIGS. 1 and 2): Top mounting straps 2, top buckles 7, bottom mounting straps 3, bottom buckles 6, front mounting bracket 4 (with optional no-slip coating at mattress interface), back mounting bracket 5 (with optional no-slip coating at mattress interface), primary tilting strap 8, primary tilting strap presenter 9, and primary lifting strap 10.

Figure 2:
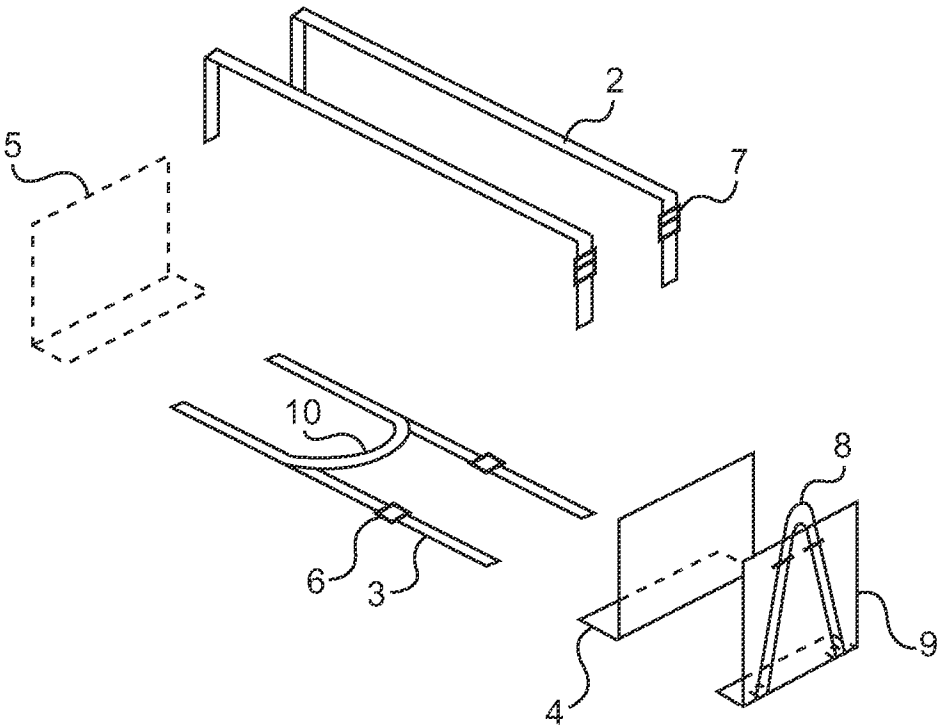
FIG. 2 is an expanded view schematic of the crib mattress caddy components without the crib mattress.

The function of each of the components of the crib mattress caddy will now be described in detail. Their relative positions are shown in FIGS. 1 and 2. FIG. 1 depicts the crib mattress caddy properly installed on a crib mattress. FIG. 2 depicts the individual components of the crib mattress caddy without the crib mattress.

Figure 7:
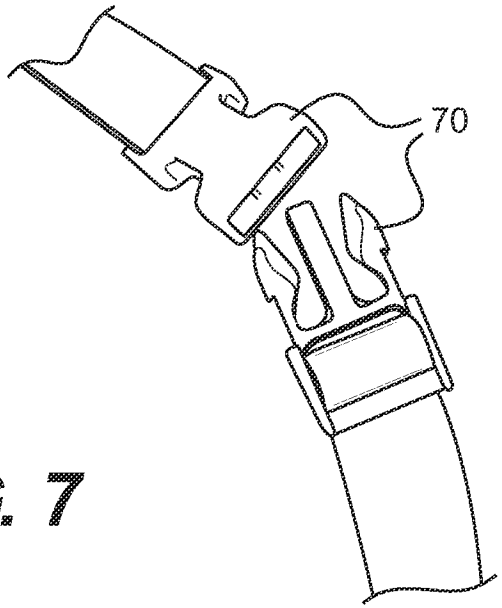
FIG. 7 is an example of a quick-snap buckle.

The top mounting straps 2 (along with the bottom mounting straps 3) secure the device to the mattress 1. The bottom buckles 6 and top buckles 7 allow the strap lengths to be adjusted for the thickness of the particular mattress being used. The top mounting straps 2 are threaded through the top buckles 7 and the bottom mounting straps 3 are threaded through the bottom buckles 6. In an alternative embodiment, quick-snap buckles 70, shown in FIG. 7, replace one or both of the pair of top buckles 7 and bottom buckles 6 and eliminate the need to thread or un-thread the straps into the buckles during installation or removal of the device on or from the mattress. The quick-snap buckles 70 may also include features to allow the tension of the top mounting straps 2 to be adjusted.

While top mounting straps 2 and bottom mounting straps 3 are shown as separate straps in FIGS. 1 and 2, an alternative embodiment can comprise two unitary straps that connect at their ends via quick snap buckles 70 or that connect by threading through a buckle such as those shown as top buckles 7. In this embodiment, the unitary strap can be threaded through slits or slots in front mounting bracket 4 and optional back mounting bracket 5. While back mounting bracket 5 is optional, it is preferable to use both front mounting bracket 4 and back mounting bracket 5 to better stabilize the crib mattress caddy on mattress 1.

The bottom mounting straps 3 (along with the top mounting straps 2) secure the device to the mattress 1. The width of the crib mattress 1 is typically a standard measurement. As such, the length of the bottom mounting straps 3 can be adjusted during manufacture accordingly. However, each mattress 1 has a different level of compliance and thus, the standard bottom buckles 6 allow for the tension in the straps to be adjusted to fit the mattress properly.

The front mounting bracket 4 and back mounting bracket 5 can both include no-slip coatings at their mattress interface surface. The no-slip coating can be, for example, a rubber gripping sheet material, a rubberized foam, or similar material. The mounting brackets provide a secure location for the straps to be joined. Furthermore, the rigidity of the mounting brackets helps to stabilize the device on a mattress 1, which has a high level of flexibility. The no-slip coating helps to keep the device from sliding length-wise along the mattress 1 during normal handling of the mattress using the device. The front mounting bracket 4 and back mounting bracket 5 are "L" shaped and may be sized so that they interface with bottom and respective side surfaces of the mattress 1, but do not reach the upper sleeping surface of the mattress 1. In this preferred embodiment, the mounting brackets are joined to the mattress such that they oppose each other in a mirror image.

The primary tilting strap 8 (along with the primary lifting strap 10) is used to lift and hold the mattress 1. The primary tilting strap 8 remains accessible after the mattress 1 is installed within the crib to facilitate removal. The primary tilting strap 8 may be positioned so that, once the mattress 1 is installed, the apex of the strap is accessible at, or just below, the top plane of the mattress. When properly installed, the primary tilting strap 8 does not pose a suffocation or entrapment risk to a child.

The primary tilting strap 8 is joined to the mattress caddy in substantially the same plane as the primary lifting strap 10 so as to pivot at locations in the plane. In this configuration, the primary tilting strap 8 and primary lifting strap 10 abut the bottom surface of a mattress 1. The primary tilting strap can then wrap around to a perpendicular mattress surface. Alternatively, the primary tilting strap can pivot in a plane perpendicular to the plane in which the primary lifting strap 10 is located.

The primary tilting strap presenter 9 keeps the primary tilting strap 8 in an accessible and visible position during normal crib use. This includes during the perturbing action of a "drop side" crib which, without the primary tilting strap presenter 9, will move the primary tilting strap 8 into an awkward and less accessible position. The primary tilting strap presenter 9 is therefore optional when the caddy is used with fixed-side cribs.

Figure 3:
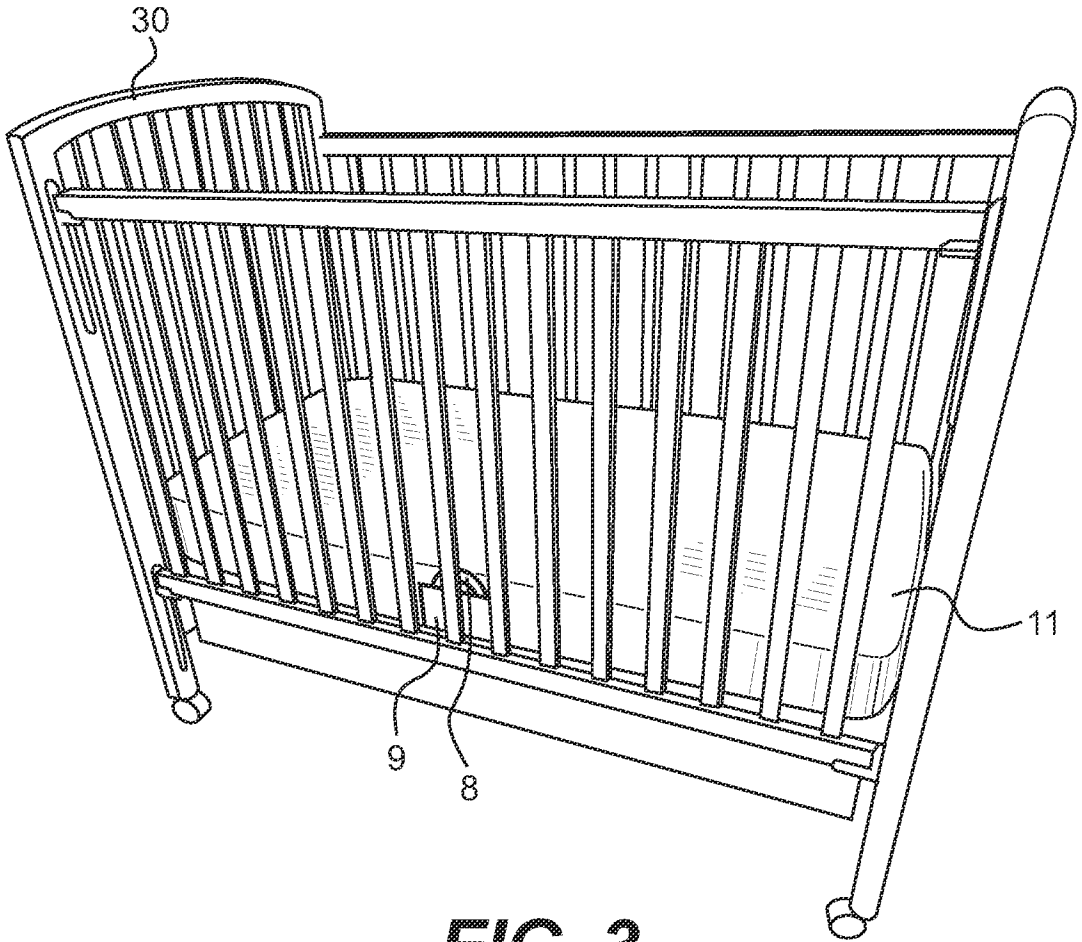
FIG. 3 is a view of the crib mattress caddy installed on a crib mattress in a crib.
Figure 4:
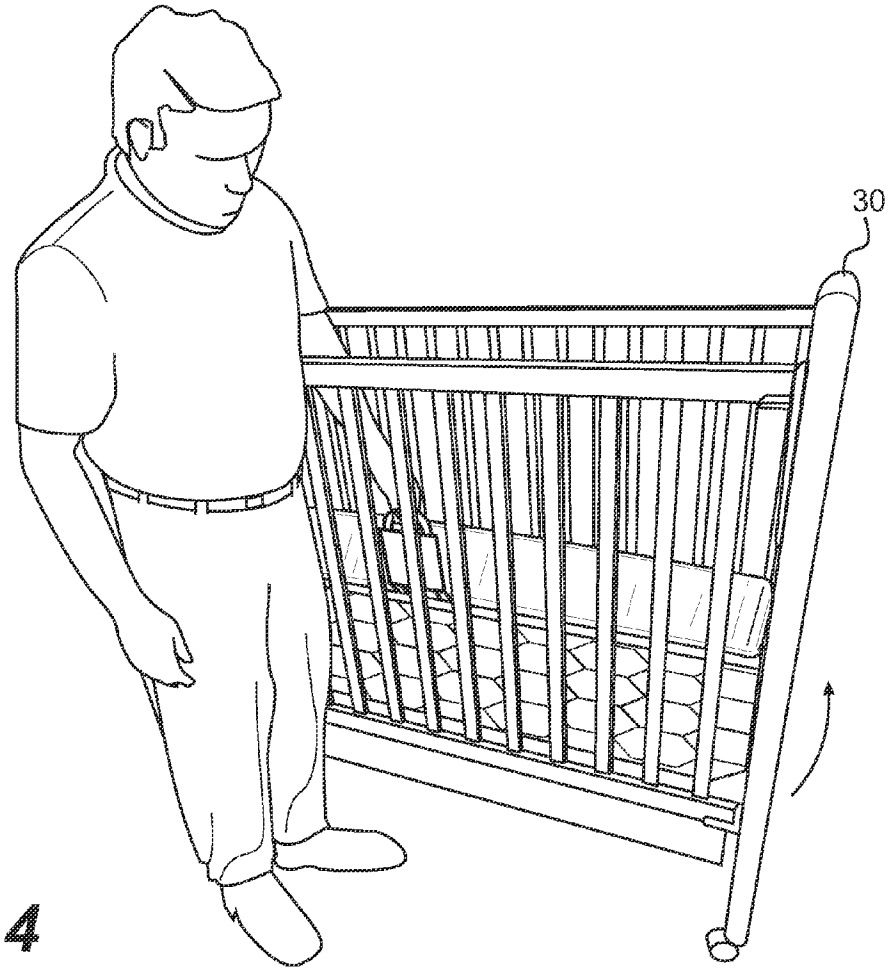
FIG. 4 is a view of the crib mattress caddy in a first removal or insertion position.

FIG. 3 shows an example of the crib mattress caddy in a crib 30. The mattress 1 is covered by a fitted crib sheet 11 and the top straps, top buckles 7, front bracket 4 and back bracket 5 are covered by the fitted crib sheet 11. The primary tilting strap 8 is accessible and visible between the mattress and railings of the crib 30. FIG. 4 shows the primary tilting strap 8 in an engaged position such that the mattress is tilted as it exits the crib 30, as further described below. As the primary tilting strap 8 is lifted in the direction of the arrow in FIG. 4, the mattress tilts to make the primary lifting strap 10 accessible.

Figure 5:
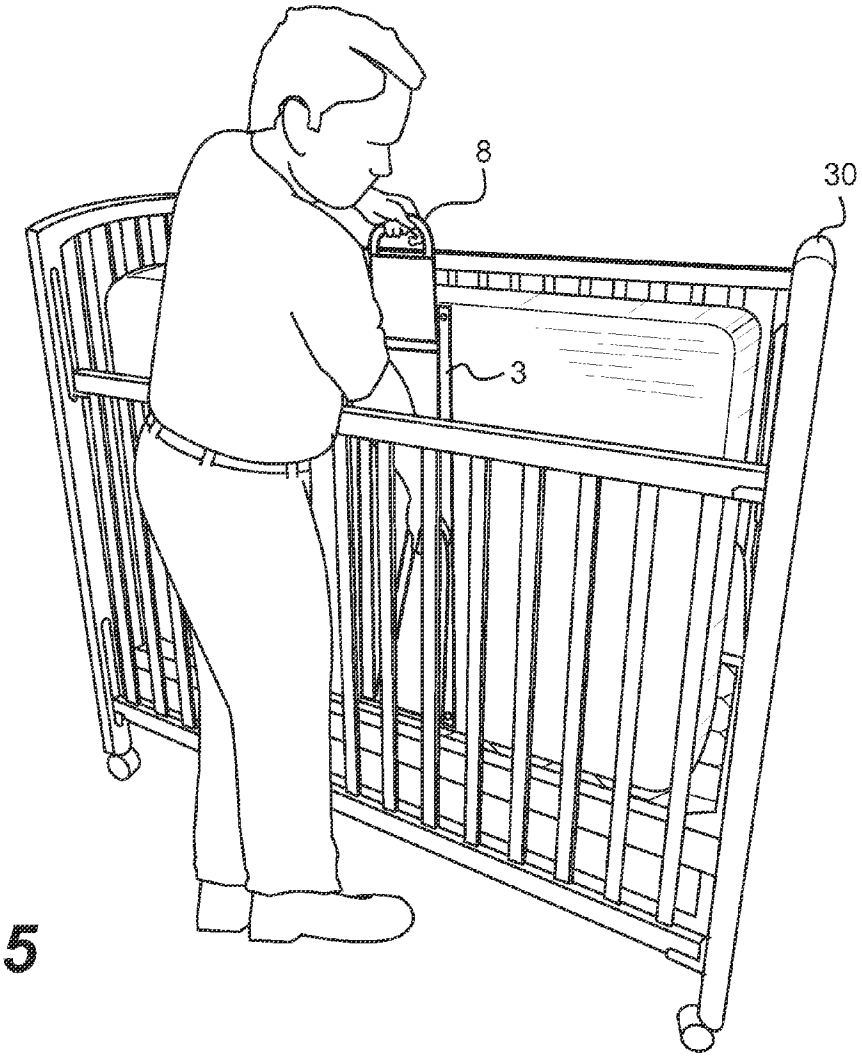
FIG. 5 is a view of the crib mattress caddy in a second removal or insertion position.
Figure 6:
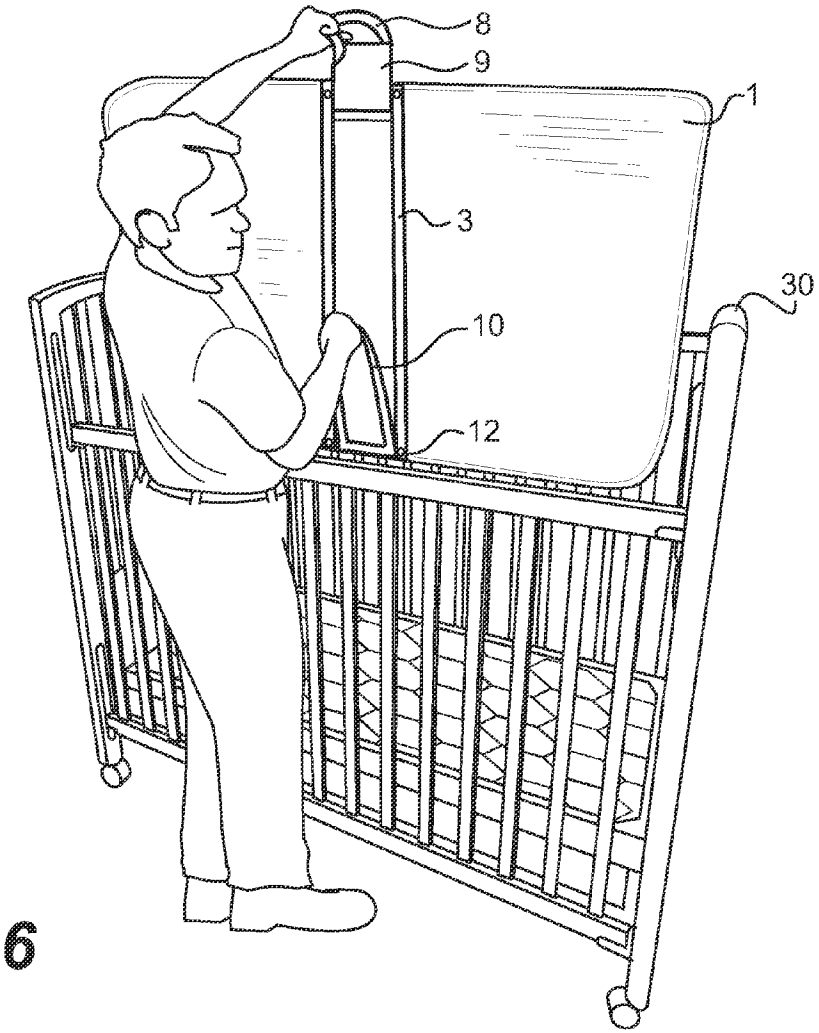
FIG. 6 is a view of the crib mattress caddy in a third removal or insertion position.

The primary lifting strap 10 (along with the primary tilting strap 8) is used to lift and hold the mattress 1. Primary lifting strap 10 is located toward the back mounting bracket 5. As shown in FIG. 5, during the mattress installation or removal process, the mattress 1 will rest temporarily along its back face, which will place the primary lifting strap 10 towards the bottom of the mattress 1. The primary lifting strap's 10 location towards the bottom of the mattress 1 will in turn provide for greater lifting leverage during mattress installation or removal. As primary tilting strap 8 is engaged to lift mattress 1 from a crib 30, the primary lifting strap 10 will become visible and accessible, as shown in FIG. 5. The back face of mattress 1 will also tilt and move toward the front of the crib 30. As shown in FIG. 6, the primary lifting strap 10 can be engaged by a user in tandem with the primary tilting strap 8 as the mattress 1 enters or exits the crib 30.

In alternative embodiments, the primary lifting strap 10 can adhere to portions of the bottom straps 3 by way of Velcro (hook and loop) tabs. This configuration presents the primary lifting strap 10 to a user at a location closer to primary tilting strap 8, thereby making it easier to grab the primary lifting strap 10. The primary lifting strap 10 is also able to pivot with respect to the mattress 1.

In an example of an implementation, mounting straps 2, 3, primary tilting strap 8, and primary lifting strap 10 may be woven nylon (preferably white in color), though other materials may be used. Nylon is preferred over cotton, since cotton can stretch and create slack. Front and back mounting brackets 4, 5 may be high density plastic (approximately 0.125 inches thick, preferably white in color). Top buckles 7, bottom buckles 6, and quick-snap buckles 70 may be high strength plastic (types commonly used in waist packs and back packs, preferably white in color). The presenter 9 may be made from a low density, but tough plastic, and can be relatively thin (approximately 0.02 inches thick). The presenter 9 can be, for example, a sheet material similar to that used on notebook covers or flexible binders. The presenter 9 must be stiff enough to keep the primary tilting strap 8 in the proper position while allowing for the primary tilting strap 8 to flex significantly during the mattress installation or removal processes.

The straps 2, 3, 8, 10 and presenter 9 can be attached to the brackets 4, 5 using rivets 12. Alternatively, the straps 2, 3, 8, 10 can be attached to the brackets 4, 5 by passing the straps through slots in the brackets and then overlapping and sewing the straps. Primary tilting strap 8 can be riveted or sewn to front mounting bracket 4 in the same location at the same time as top straps 2. Likewise, primary lifting strap 10 can be riveted or sewn to back bracket 5 in the same location at the same time as bottom straps 3. In an embodiment where top straps 2 are unitary with bottom straps 3, primary lifting strap 10 can be riveted or sewn to the straps.

Portions of the straps 2, 3 can be attached to top buckles 7, bottom buckles 6, and quick-snap buckles 70 by passing through slots in the buckles and then overlapping and sewing the straps. Other portions of straps 2, 3 can pass through top buckles 7, bottom buckles 6, and quick-snap buckles 70 in a known manner to allow the length of the straps 2, 3 to be adjusted. All components may be pre-assembled and, in this example, only the top mounting straps 2 need to be mated during installation (described below). In alternative implementations, the caddy can comprise all quick-snap type buckles 70 or all standard type pass-through buckles 6, 7. And, the quick-snap type buckles 70 can comprise a portion for allowing the strap length to be adjusted.

An installation procedure for the crib mattress caddy is as follows: Remove all sheets and mattress pad (use of mattress pad is optional) from mattress 1. De-mate top mounting straps 2 by unthreading top buckles 7, or, in alternative embodiments, by squeezing release mechanisms on quick-snap buckles 70. Place crib mattress caddy on ground with short side of front 4 and back 5 mounting brackets on ground. Spread brackets apart as far as the bottom mounting straps 3 will allow. Place mattress 1 over the crib mattress caddy and position mattress 1 so the crib mattress caddy is centered on mattress 1 in long direction. Bring top mounting straps 2 over the top of mattress 1 and re-mate. Take out slack in top mounting straps 2 by pulling on loose ends of each top mounting strap 2. Tilt mattress 1 up and snug bottom mounting straps 3 by pulling on loose ends of each bottom mounting strap 3. Rest mattress 1 back down and snug top mounting straps 2 by pulling on loose ends. Check for fit of all mounting straps 2, 3 and snug straps again to secure. Crib mattress caddy should not slide. Re-install mattress pad (optional) and fitted sheet. When installing a fitted sheet and a mattress pad, ensure primary tilting strap 8 and primary tilting strap presenter 9 are on the outside of the sheet and pad so that they remain visible after the sheet and pad are installed. The crib mattress caddy is now ready for use.

The following describes an example of a procedure for installing the mattress 1 into a crib and the procedure may include following FIGS. 4-6 in reverse: Tilt up mattress 1 using the primary tilting strap 8 (on front bracket 4) and grab hold of the primary lifting strap 10 underneath mattress. Lifting with the legs and not your back, lift up mattress 1 using both the primary tilting strap 8 and the primary lifting 10 strap and place mattress 1 into crib. Place or push back bracket 5 toward the back of the crib and then lower mattress 1 with the primary tilting strap 8. The mattress 1 is now ready for use.

To remove the mattress 1 from the crib, the following procedure may be used, and may include the steps illustrated in FIGS. 4-6: Tilt up mattress 1 using the primary tilting strap 8 (on front bracket 4) and grab hold of the primary lifting strap 10 underneath mattress 1. Slide or pull back bracket 5 toward front of crib. Grab hold of the primary lifting strap 10 and the primary tilting strap 8. Using a straight back and using your arms, not your back, lift the mattress 1 and remove from crib. Using your legs, not your back, lower mattress 1 to the ground.

Other lifting techniques using the arms, legs, or back may be used without compromising the functionality of the crib mattress caddy. The example techniques used above are for user safety.

Although the foregoing invention has been described in detail by way of illustration and example for purposes of clarity of understanding, it will be readily apparent to those of ordinary skill in the art in light of the description herein that certain changes and modifications may be made thereto without departing from the spirit or scope of the appended claims. It is also to be understood that the terminology used herein is for the purpose of describing particular aspects only, and is not intended to be limiting, since the scope of the present invention will be limited only by the appended claims.

We claim:

1. A mattress caddy comprising:

at least two top mounting straps each top mounting strap having a respective first end and a second end;

at least two bottom mounting straps each bottom mounting strap having a respective first end and a second end;

a front bracket comprising an inner surface for interfacing with a mattress;

a back bracket comprising an inner surface for interfacing with the mattress;

a primary tilting strap;

a primary tilting strap presenter attached to the front bracket; and a primary lifting strap;

wherein:

the first ends of the at least two top mounting straps are attached to the front bracket and the second ends of the at least two top mounting straps are attached to the back bracket, the first ends of the at least two bottom mounting straps are attached to the front bracket and the second ends of the at least two bottom mounting straps are attached to the back bracket, the primary tilting strap is attached to the front bracket, the primary tilting strap presenter interfaces with the primary tilting strap, and the primary lifting strap is attached to the back bracket.

2. The mattress caddy of claim 1 wherein the at least two top mounting straps and the at least two bottom mounting straps further comprise buckles configured to allow for the adjustment of the length of the top mounting straps and the bottom mounting straps.

3. The mattress caddy of claim 2, wherein each top mounting strap is configured to separate at a respective interface with a respective buckle.

4. The mattress caddy of claim 2 wherein at least two of the buckles of the at least two top mounting straps and the at least two bottom mounting straps are quick snap buckles.

5. The mattress caddy of claim 1 wherein the inner surface of the front bracket and the inner surface of the back bracket comprise a no-slip surface.

6. The mattress caddy of claim 1 wherein the at least two top mounting straps, the at least two bottom mounting straps, the primary tilting strap, and the primary lifting strap are made of woven nylon.

7. The mattress caddy of claim 1 wherein the at least two bottom mounting straps, the primary tilting strap, and the primary lifting strap are attached to respective front brackets and back brackets using rivets.

8. The mattress caddy of claim 1 wherein the front bracket comprises slots and the back bracket comprises slots, and wherein the at least two bottom mounting straps, the primary tilting strap, and the primary lifting strap are attached to respective slots in the front brackets and back brackets by sewing respective portions that have been overlapped after passing through respective slots in the respective front brackets and back brackets.

9. The mattress caddy of claim 1, wherein the primary tilting strap presenter is configured to retain the primary tilting strap in an accessible position during normal use in a crib.

10. The mattress caddy of claim 1 wherein the primary tilting strap presenter comprises a flexible plastic material.

11. The mattress caddy of claim 1 wherein the primary tilting strap presenter is configured to install on a side of a mattress and maintain the primary tilting strap at a level at or just below a top surface of the mattress.

12. The mattress caddy of claim 1 wherein the primary tilting strap presenter is configured to pivot with respect to the front bracket.

13. The mattress caddy of claim 1, wherein the primary tilting strap and the primary lifting strap are joined to the mattress caddy in substantially the same plane so as to pivot at locations in the plane.

14. The mattress caddy of claim 1, wherein the front bracket and the back bracket are "L" shaped and are joined to the mattress caddy such that they oppose each other in a mirror image.

15. The mattress caddy of claim 1, wherein the top mounting straps and the bottom mounting straps are integral along respective side portions.

16. The mattress caddy of claim 1, wherein the primary tilting strap presenter provides at least one pivot point for the primary tilting strap.

17. A mattress caddy comprising:

two mounting straps configured to encircle a mattress;

a front bracket comprising an inner surface configured for interfacing with two perpendicular planes of the mattress;

a primary tilting strap;

a primary tilting strap presenter; and a primary lifting strap;

wherein:

the two mounting straps are attached to the front bracket, the primary tilting strap is attached to the front bracket, the primary tilting strap interfaces with the primary tilting strap presenter, the primary tilting strap presenter provides at least one pivot point for the primary tilting strap, and the primary lifting strap is attached to each of the two mounting straps.

* * * * *